US006112739A

United States Patent [19]

Hoerner et al.

[11] Patent Number: 6,112,739

[45] **Date of Patent: *Sep. 5, 2000**

[54] METHOD FOR HIGH SPEED CUTTING

[75] Inventors: Steven W. Hoerner, East Aurora, N.Y.; Gene A. Fisher, Largo, Fla.; Edwin C. Pow, Suwanee, Ga.

[73] Assignee: Norton Company, Worcester, Mass.

[ * ] Notice: This patent is subject to a terminal disclaimer.

[21] Appl. No.: 08/984,358

[22] Filed: Dec. 3, 1997

Related U.S. Application Data

[63] Continuation of application No. 08/550,306, Oct. 30, 1995, Pat. No. 5,735,259.

[51] Int. Cl.[7] ..... B28D 1/08

[52] U.S. Cl. ..... 125/21; 451/527

[58] Field of Search ..... 125/21, 22, 11.01; 451/527, 298, 489, 528–530

[56] References Cited

U.S. PATENT DOCUMENTS

| | | | |
|---|---|---|---|
| 3,598,101 | 8/1971 | Hensley | 125/21 |
| 4,015,931 | 4/1977 | Thakur | 125/21 |
| 4,016,857 | 4/1977 | Hall | 125/18 |
| 4,097,246 | 6/1978 | Olson | 125/21 |
| 4,580,545 | 4/1986 | Dorrsten | 125/21 |
| 4,603,678 | 8/1986 | Fish | 125/21 |
| 4,679,541 | 7/1987 | Fish | 125/21 |
| 4,907,564 | 3/1990 | Sowa et al. | 125/21 |
| 4,920,947 | 5/1990 | Scott et al. | 125/21 |
| 4,945,889 | 8/1990 | Fish | 125/21 |
| 4,971,022 | 11/1990 | Scott et al. | 125/21 |
| 5,080,086 | 1/1992 | Tomlinson et al. | 125/21 |
| 5,181,503 | 1/1993 | Fish et al. | 125/21 |
| 5,184,598 | 2/1993 | Bell | 125/21 |
| 5,215,072 | 6/1993 | Scott | 125/21 |
| 5,216,999 | 6/1993 | Han | 125/21 |
| 5,305,730 | 4/1994 | Fish | 125/21 |
| 5,603,311 | 2/1997 | Hoerner et al. . | |
| 5,735,259 | 4/1998 | Hoerner et al. | 125/21 |

*Primary Examiner*—Derris H. Banks
*Attorney, Agent, or Firm*—Mary E. Porter

[57] ABSTRACT

The present invention is a method of using a high speed cutting belt for cutting various aggregate and non-aggregate, natural stone and composite building materials with steel or non-steel reinforced materials. The cutting belt comprises a tensile member base, a plurality of cutting segments brazed with brass shim stock to anchors and crimped to the tensile member base, and molded in urethane to form a continuous, flexible belt, said belt having a 90° "V" shaped bottom inner surface and a flat, outer top surface.

12 Claims, 6 Drawing Sheets

32
32

30
33
33
31
31

4
4
32
33
33
33
34
35

33
27
33
33
33
33
32
32
35
34
36
36

METHOD FOR HIGH SPEED CUTTING

This application is a continuation of U.S. Ser. No. 08/550,306, filed Oct. 30, 1995, which was allowed on Aug. 14, 1997 U.S. Pat. No. 5,735,259.

BACKGROUND OF THE INVENTION

1. Field of the Invention

This invention relates in general to cutting devices and in particular to a high speed cutting belt and structure for cutting various aggregate and non-aggregate, natural stone and composite building materials having steel or non-steel reinforcing.

2. Background of the Invention

A chain saw is commonly used to fell, buck and delimb trees. The saw chain, the power head, and the coupling components that made up a wood cutting chain saw have been highly developed. The steel cutting links of the saw chain slide along a steel guide bar at a high rate of speed driven by a drive sprocket connected to the drive shaft of the power head. The guide bar is a plate-like member with an oval guide edge provided with a guide slot flanked by guide rails. The saw chain is made up of interconnected center and side link pairs. The center links include a depending tang that slides in the guide grooves and the side links have bottom edges that slide on the guide rails.

The cutting links which are commonly provided as one of the side links of each pair of side links, have an upwardly or outwardly extended portion formed into forwardly directed cutting edges. These cutting edges engage the wood body and cut out wood chips.

The entire process of wood cutting with a chain saw involves metal sliding on metal pounding on metal in reaction to the fast moving chain engaging the wood and removing chips. The wear problem is extremely acute and yet has been largely overcome by metal processing technologies that provide hard metal where wear resistance is desirable, ductile metal where fatigue resistance is desirable, etc. All of this enables the production of a commercially feasible wood cutting tool, i.e., a chain saw with a reasonable life expectancy at a reasonable cost.

Cutting concrete, stone and other hard, brittle materials requires a different type of cutting edge than the one used to cut wood. Typically such materials are cut with small cutting blocks composed of a metal matrix having graded industrial diamond particles impregnated therein. The blocks are attached to a cutting tool, that is, to the periphery of a circular blade, or to a steel cable. Most commonly used are the circular blades.

There are several problems that are encountered by chain saws that do not exist for circular saws. The saw chain and guide system involve numerous parts sliding against each other. The side links and center links pivot relative to each other on rivets or pins, the side link bottom edges slide on the guide bar rails, and center link drive tangs slide in the guide bar groove. Whereas technology developed heretofore enables this sliding relationship for wood cutting, that is not the case for aggregate cutting.

When cutting cement and stone, fine particles are ground out of the aggregate medium creating a dust that settles on the saw chain and its components. This dust gets between the sliding parts of the bar and chain links and acts as an abrasive to rapidly wear the hardest of steel surfaces. Also, the heat that is generated in cutting the hard aggregate materials is so high that similar steel to steel sliding creates an "adhesive" type of wear between engaging parts. This is an inherent welding action that takes place due to the extensive heat that is generated between the parts. Beads of the material are formed in this welding process that break off as particles. Over a period of time, the engaging surfaces are rapidly worn away.

The above problems are however secondary. The primary problem is the provision of a cutting element with sufficient life. Obviously, if the cutting element cannot be retained by the saw chain for any period of time, the fact that the moving or sliding parts are rapidly wearing is of little consequence. The cutting element that is desired for cutting through aggregate material is a metal matrix impregnated with diamonds. It is not practical to make the cutting links entirely of this material. Using a chain saw also limits the working width of the cutting surface since the size of the metal components of the chain determine the narrowest cut possible.

Several prior art patents have attempted to solve the abovementioned problems. U.S. Pat. No. 4,603,678 to Fish discloses a stone cutting device including a continuous flexible cutting belt for cutting a slot in stone which is in the ground. The device includes a main frame, a jib pivotally mounted to the main frame, aligned sheaves rotatably mounted to the main frame and jib, a continuous flexible cutting belt extending around and in driven engagement sheaves, and a means to rotate at least one of the sheaves. The continuous flexible cutting belt includes a plurality of spaced apart abrasive cutting elements extending across the top and sides of the belt. Belt strength is provided by a flexible cable extending through the length of the belt.

U.S. Pat. No. 4,679,541 to Fish is a Continuation-In Part of U.S. Pat. No. 4,603,678 to Fish and includes claims drawn to an embodiment including a groove on the top and bottom edges of the jib and outlet means opening in the groove allowing water to be emitted between the groove and the belt to provide lubrication and reduced vibration as the belt passes through the groove. During operation, the water thus emitted from the jib passes outside the groove and into the cut slot in the stone and washes away stone cuttings for improved operation.

U.S. Pat. No. 4,920,947 to Scott et al discloses a chain saw for cutting aggregate materials including a saw chain of interconnected center links and side link pairs composed of heat-treated steel. Certain pairs of the side links support diamond impregnated matrix cutting blocks that are laser welded to the side links in a process where the laser beam is focused and orbited along the juncture to avoid stress risers in the steel material of the supporting side links. The guide bar is provided with a pattern of enclosed channels for directing water to the guide bar groove at spaced positions on the periphery of the guide bar edge for flushing away the aggregate dust generated by the cutting process.

U.S. Pat. No. 4,971,022 to Scott et al is related to U.S. Pat. No. 4,920,947 above and includes details of a cutting chain for aggregate materials. The cutting link structure is a folded plate-like member formed into spaced side plate portions and an overhead connecting web. The side plate portions function like side links in a conventional saw chain and ride on the rails of a guide bar.

U.S. Pat. No. 5,184,598 to Bell discloses an articulated saw chain for cutting aggregate material. The saw chain has cutting blocks affixed to pairs of side links and guards formed or attached to side link pairs positioned between successive cutting blocks. The guard portions extend to substantially the same height as the cutting block to protect the edge of the cutting blocks from impacting against an object.

U.S. Pat. No. 5,215,072 to Scott discloses a cutting element and saw chain for cutting aggregate material comprising a saw chain having a right and left support links carrying the diamond mesh upon inclined support surfaces relative to the travel axis of the saw chain. The abrasive particle impregnated mesh contacts the material to be cut only adjacent its trailing edge. A consumable material exists between the impregnated mesh and the support surface. The impregnated mesh may extend downward along the side of the support link to maintain a constant kerf width.

SUMMARY OF THE INVENTION

The present invention is a high speed grinding belt for cutting various aggregate and non-aggregate, natural stone and composite building materials having steel or non-steel reinforcing. Designed for use on both a hand held and/or mounted tool, it will contain a high percentage of plastic compounds and composites. A guide bar is the parent component in the system. An integral water distribution system will aid in hydroplaning the belt-like carrier, thereby cooling and flushing while keeping adhesive and friction related wear, and resultant horse power losses to a minimum. The belt comprises a metallic cable, forming one or more endless loops and will have diamond impregnated segments mechanically fastened to cables. The drive sheave will be a metal, cast, and machined to accept a thermal spray tractive coating.

DESCRIPTION OF THE PREFERRED EMBODIMENT

Figure 1:
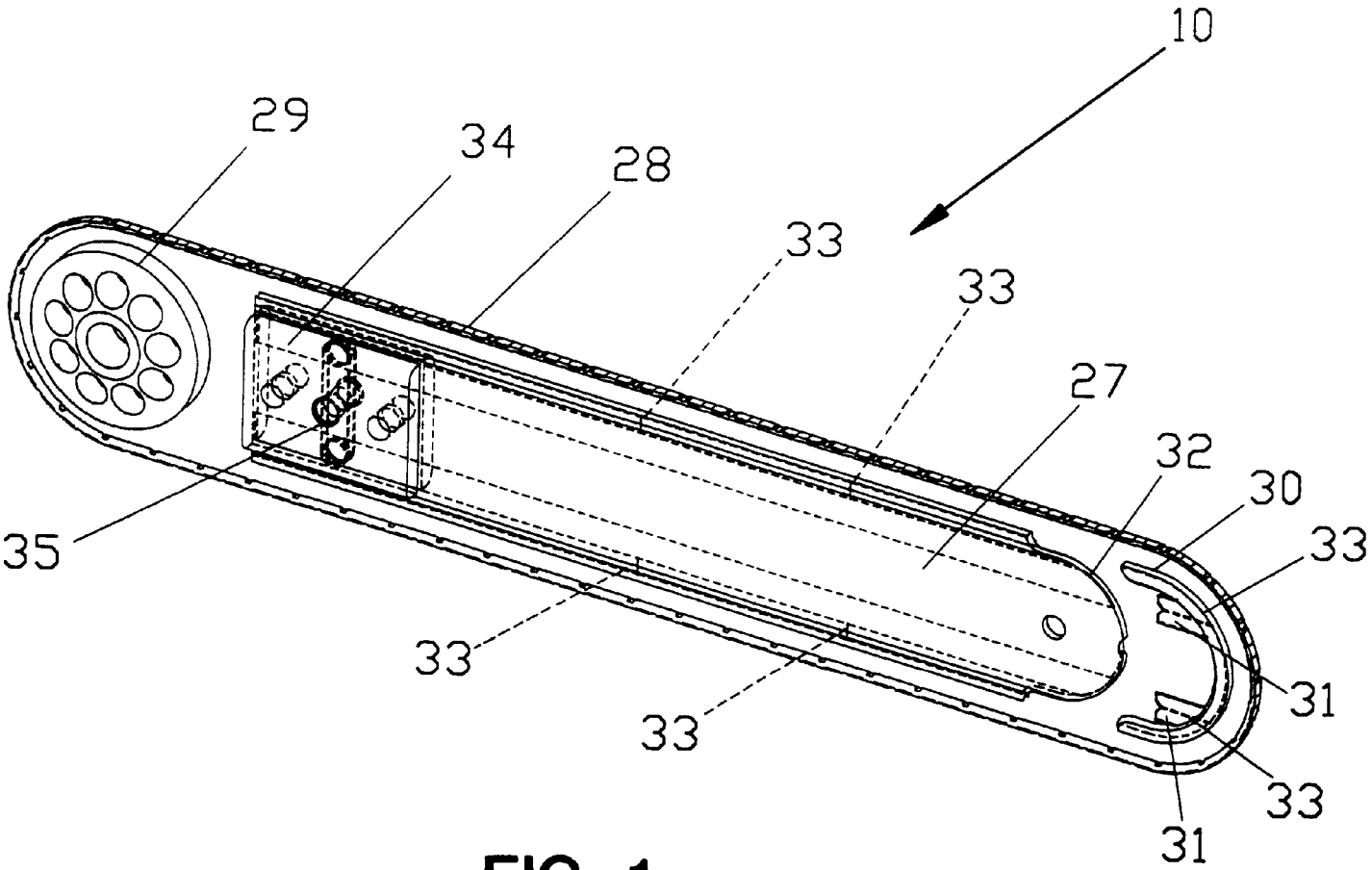
FIG. 1 is a top perspective view of the belt based cutting system of the invention.
Figures 2, 3, 4, 5:
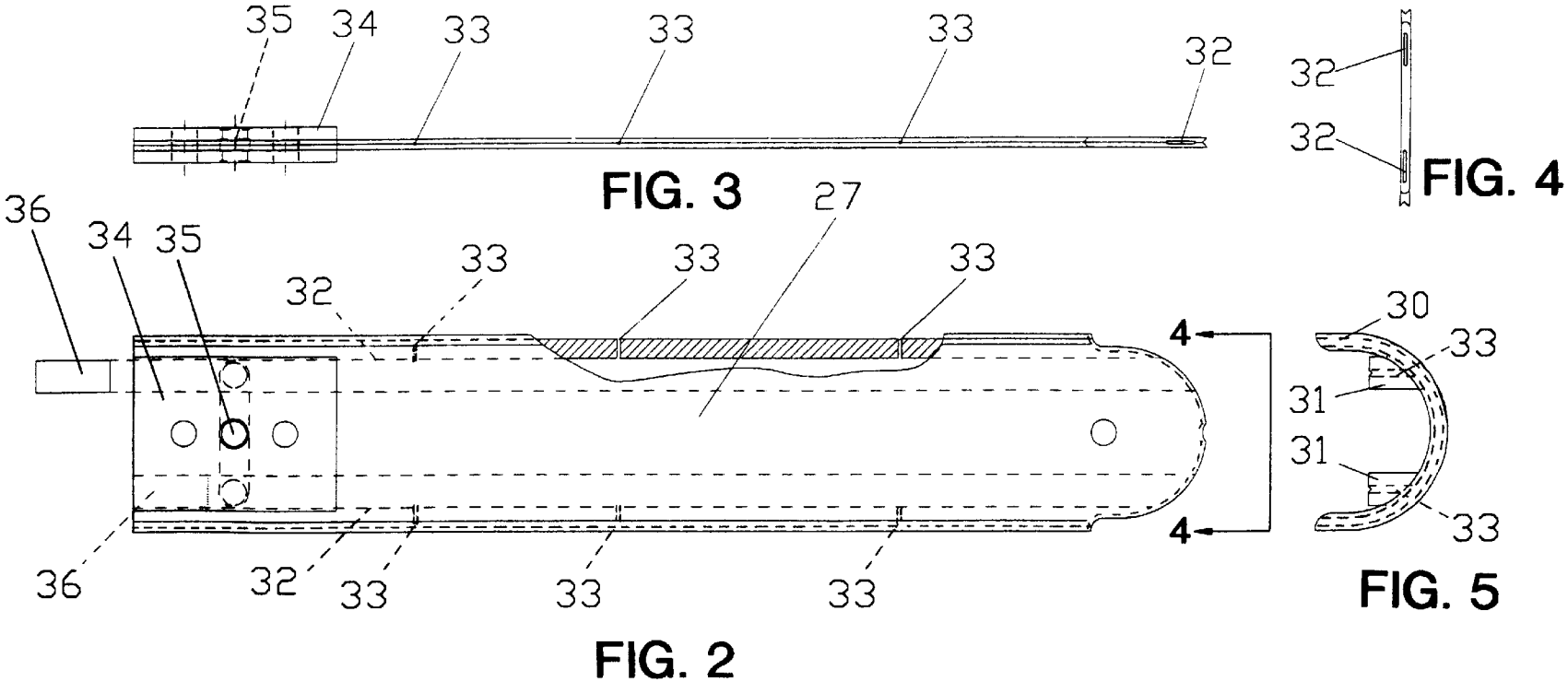
FIG. 2 is a side view of the guide bar for the cutting belt of the invention.
FIG. 3 is a top view of the guide bar for the cutting belt of the invention.
FIG. 4 is an end view of the guide bar for the cutting belt of the invention.
FIG. 5 is a side view of the bar nose for the belt based cutting system of the invention.
Figure 6:
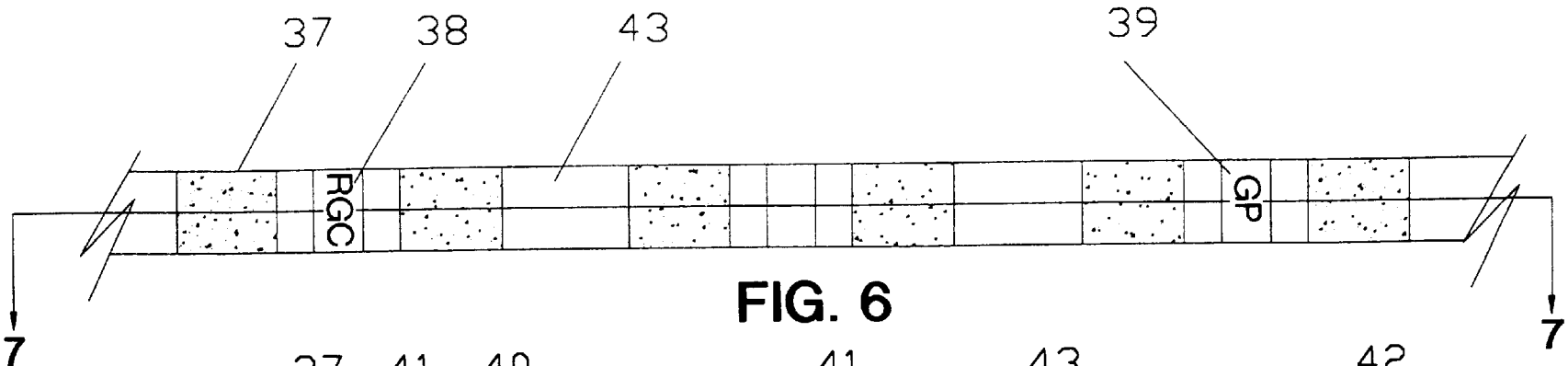
FIG. 6 is a top plan view of a cutting belt surface.
Figure 7:
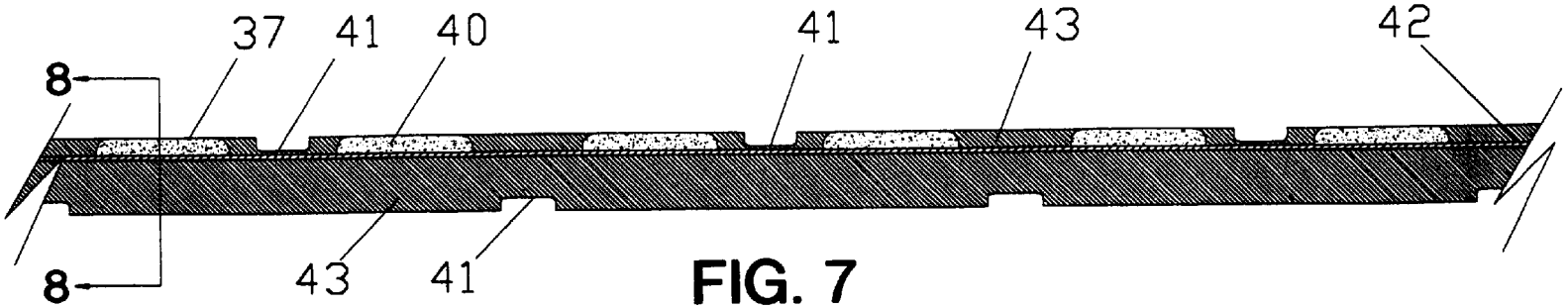
FIG. 7 is a side view of a cutting belt in accordance with the invention, partly cutaway.
Figure 8:
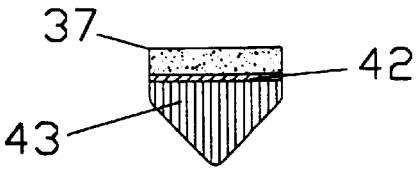
FIG. 8 is a sectional view of a first embodiment of the cutting belt of the invention.
Figure 9:
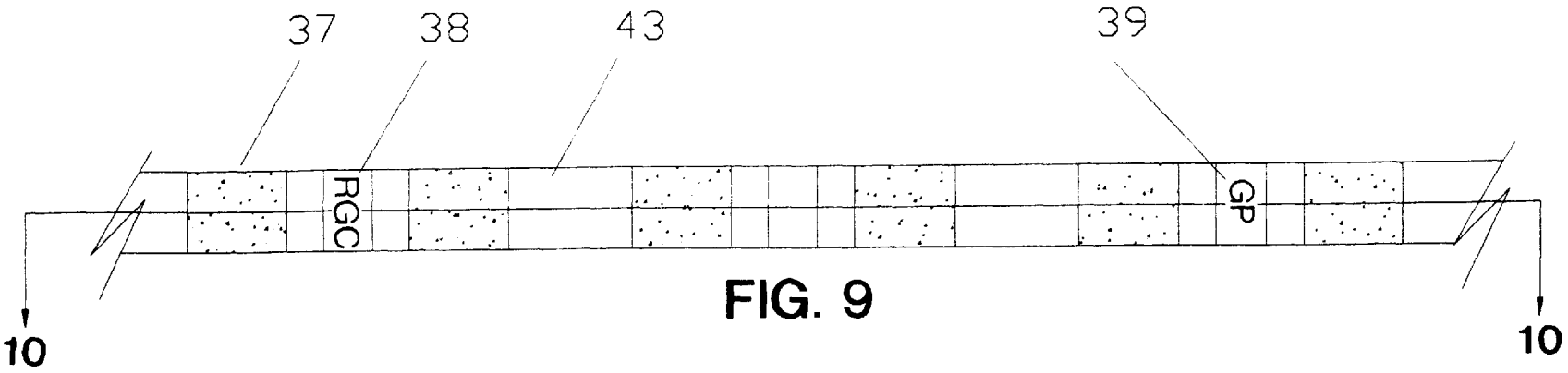
FIG. 9 is a top plan view of a second embodiment of a cutting belt in accordance with the invention.
Figure 10:
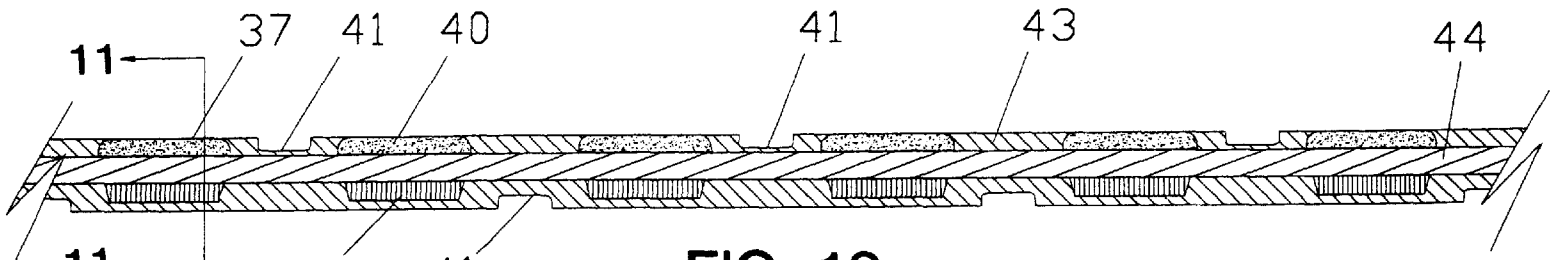
FIG. 10 is a side, sectional view of a second embodiment of the cutting belt of the invention.
Figure 11:
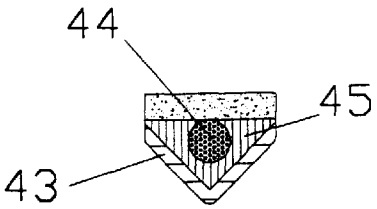
FIG. 11 is a sectional view of a second embodiment of the cutting belt of the invention.

Referring to FIG. 1 of the drawings, a belt based cutting system is generally indicated by the numeral 10. FIG. 1 is a top perspective view of the system 10 showing the guide bar 27, cutting belt 28 mounted on guide bar 27, over bar nose 30 and over drive sheave 29. Drive sheave 29 will have a tractive coating (not shown) in the "V" shaped drive or contain an insert (not shown). The belt based cutting system 10 of the invention are the consumable items and ultimately the replacement components for the prior art chain-based system.

The hydraulic motor and the associated hydraulic system used to drive the belt based cutting system 10 are part of a Power Head manufactured and sold by RGC Corporation, P.O. Box 681, Buffalo, N.Y. 14240 and will be described only in general terms. In the preferred embodiment, a modified HYDRA CUTTER C150 was used (not shown). The hydraulics required to operate the system are 16 hp/8 GPM/2500 psi and the water required is 1–2 GPM/400psi. The prior version of the cutter used a diamond segmented chain saw for the cutting system.

The component names are: one to three cutting belt 28 selections, one to three bar nose 30 selections, one to two guide bars 27, and one drive sheave 29. The belt based cutting system 10 requires this Power Head to operate due to one integral feature. This feature will control the belt during start/stop and the cutting operation of the tool. The AUTO TENSIONING SYSTEM senses operator input and tensions the belt 28 proportionally. Identical parts noted in the preferred embodiment will first be put into use on the present Model C150 power head for retrofit purposes.

The belt based cutting system 10 consists of similar type consumable items and will replace chain based cutting system components on the present power head.

The belt 28 may be made of polyether-based polyurethane thermoplastic elastomer with fillers to enhance properties, or polyether-based polyurethane thermoset elastomer with fillers to enhance properties. Centrifugal cast or injection molding processes may be used to make the belt 28.

The guide bar 27 may be made of a polyether-based polyurethane thermoplastic elastomer with matrix composite. Carbon fibers will be centered for strength and overbraided to obtain required mechanical properties. The pultrusion process will also be utilized. In addition, an extruded aluminum guide bar 27 having a thermally sprayed hard/slick coating in the "V" groove 48 may be utilized.

The bar nose 30 will be made of a polyether-based polyurethane thermoplastic or thermoset elastomer with fillers to enhance required properties. Pressure casting and injection molding processes will also be used.

The drive sheave 29 will be made of alloyed aluminum to support the abovementioned tractive coating. The power to the belt 28 is transmitted by means of a high coefficient of friction with the abovementioned tractive coating or insert, with many "positive" points of engagement, thereby further eliminating the problems with the change of pitch on both 76 drivelinks of the chain and drive sprocket having 14 teeth.

The highly wear-resistant, one piece non-rotating bar nose 30 will eliminate the majority of problems that are now experienced with the prior art system. Replacing the bar nose bearings, inner race and sprocket of the chain saw bar, with a single, replaceable part will help all other aspects of the cutting system, under some of the most severe operating conditions.

The guide bar 27 is another consumable item in the system, and offers an integral water distribution system -that consists of dual reservoirs to deliver the required water to the belt 27 underside. The water distribution system comprises water inlet 35, reservoir plugs 36, water reservoirs 32 and water outlets 33. Bar nose tangs 31, which fit within reservoirs 32, provide water through water outlets 33 to the "V" groove 51 in bar nose 30 and to retain the bar nose 30 mated with guide bar 27.

The segmented belt 28 is encased with a highly wear resistant polymeric material 43, such as urethane, that will come in contact with the workpiece during the cutting process and will also guide the belt 28 down the "V" groove 48 in the guide bar 27 and the bar nose 30, resulting in a very stable, very straight, and very smooth cutting tool operation. The guide bar 27 is another consumable item in the system, and offers an integral water distribution system that consists of dual water reservoirs 32 to supply the required water. The two reservoirs 32 make the guide bar 27 unique from all other guide bars, and allows for a minimal pressure drop between the water supply and the water exit ports, water outlets 33. The lubricating and cooling water 46, will disperse into the guide bar 27 "V" groove 48 rail surfaces (90° "V") from the reservoirs 32 to float the belt 28 around the guide bar 27 during cutting. The hydrodynamically floating of the belt 28 under pressure makes this guide bar 27 distinct from all other guide bars on the market.

The water outlets 33 will be sized to proportion the water flow at a working pressure to at least six ports whereby the percentages of flow from the reservoirs 32 will be adjusted to disperse 50–75% of that flow to the bar nose 30. This will allow the belt to freely rotate around the bar nose 30 with minimal horsepower losses, while continuing to cool and flush the system.

FIGS. 6 through 14 show details of the belt 28. A first embodiment shown in FIGS. 6–8 utilizes a flat steel ribbon 42 tensile member as the base for building the belt 28. A second embodiment shown in FIGS. 9–11 utilizes wire cable 44 tensile member as the base for building the belt 28. Segment loss is prevented by the use of a single tensile member joined with one connection point, for a minimum two times the design life expectancy. Both ends are joined by either inserting them into a butt-connector using a high strength/low temperature molten metal to tin and join inside the butt-connector, or crimping cable connectors at predetermined intervals for required integrity.

Tensile members 42 or 44 are put into tension prior to the molding process to insure the proper "sizing" of the belts 28. In a specific first example of the belt 28, tensile member 42 was a 0.010×0.205 wide stainless steel flat belt with 100 matrix 40 segments brazed atop the belt 28, equally spaced. The abrasive matrix 40 segments were spaced 0.250 between each of 100 segments. In a second specific example of the belt 28, tensile member 44 was a 1/16" diameter wire rope continuous loop with 100 matrix 40 segments affixed to anchors 45 and brazed to tensile member 44 with brass shim stock. The matrix 40 segments may be formed, for example, of a composition of cobalt, iron, nickel, carbide, and industrial diamonds.

The assembly of the tensile members 42 or 44 are then placed in tension in a mold. Urethane 43 is then molded over the entire assembly. Reliefs 41, for removal of particulate material, are molded and centered between segments. In a specific example, the reliefs 41 were 0.125 inches long× 0.205 inches wide×0.030 inches deep, with 50 reliefs 41 per belt 28. Manufacturer's initials 38, and belt type identification 39 are molded into the belt 28 top surface. Each of the matrix 40 segments and tensile members 42 and 44 will be fully encapsulated with urethane 43. In the two specific examples described above, the width of the matrix 40 segments was 0.205 inches and the length was 0.565 inches from edge to edge. The width of the matrix 40 segments may be within a range of 0.185 to 0.250 inches wide. The height of the matrix 40 segments from the abrasive surface 37 and the bottom of the urethane "V" shaped belt 28 bottom was 0.176 inches. In the second example of the belt 28, with the tensile member 44, the belt 28 has a 0.020 inches urethane thickness typical at both sides of the bottom of anchors 45. In this application, the use of urethane or polyurethane are synonymous.

Figure 12:
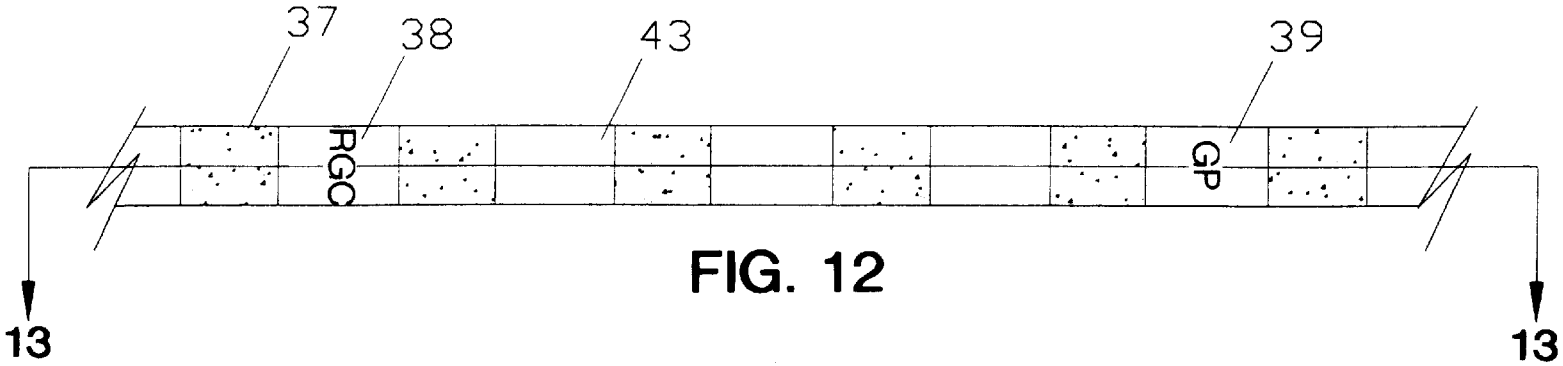
FIG. 12 is a top plan view of a third embodiment of the cutting belt of the invention.
Figure 13:
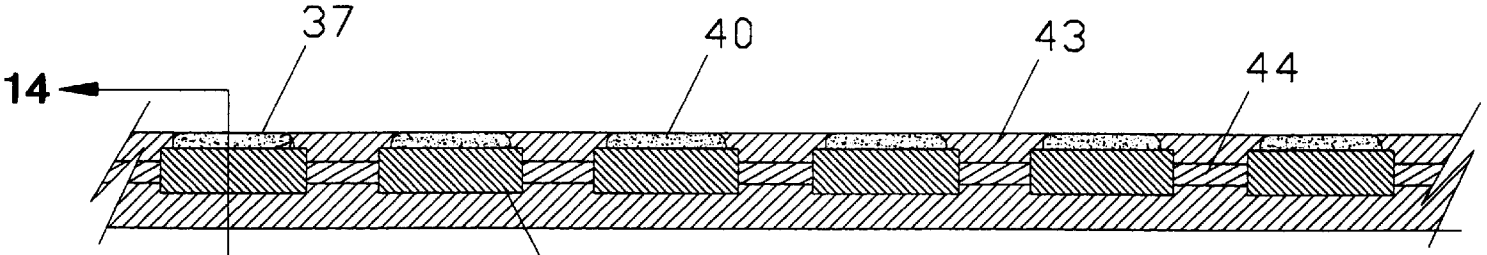
FIG. 13 is a side sectional view of a third embodiment of the cutting belt of the invention.
Figure 14:
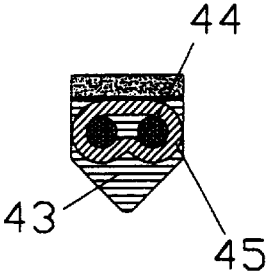
FIG. 14 is a sectional view of a third embodiment of the cutting belt of the invention.
Figure 15:
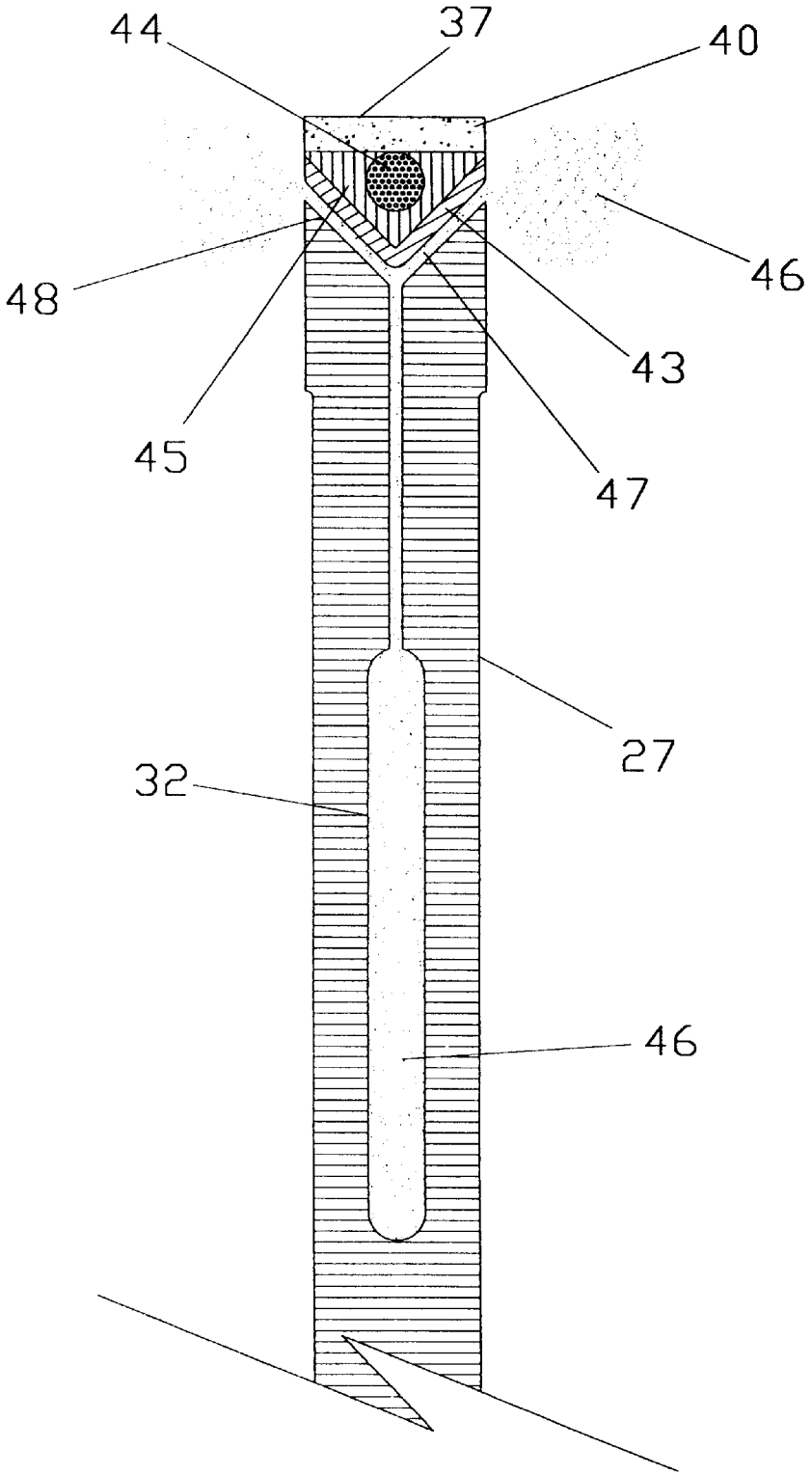
FIG. 15 is a sectional view of a cutting belt and its relationship to a guide bar of the invention.

FIGS. 12 through 14 disclose a third embodiment utilizing wire cables 44 tensile members wrapped in a continuous loop and thus forming a double wrap with anchors 45 having two wire cables 44 running therethrough, side by side, and crimped to the anchors 45. The ends of the two wire cables 44 are staggered and lap spliced (not shown). In an example of a preferred embodiment, the overall height of the belt 28 was 0.248 inches, the width 0.205 inches, the length of the anchor 45 was 0.250 and the width of the anchor 45 was 0.205. Reliefs 41, not shown in FIGS. 12 through 14, may also be provided. In addition, manufacturer's initials 38 and belt type identification 39 will be provided in one space between the matrix segments 40.

The molded belt 28 will generally be produced in at least three versions, General Purpose (GP), Green Concrete (GC), and Heavy Steel (HS). The belt type identification 39 will indicate the purpose of the belt. The belt based cutting system 10 of the invention is a versatile and efficient cutting tool and may be used in construction, remodeling, maintenance, demolition, and rescue. The system will cut through reinforced concrete (prestressed cable, rebar or wire), natural stone, building tile, concrete block, pumice block and stone composites. It will be used to: plunge cut—to a full 16 inches in depth; corner cut—square corner cuts for doors, windows and air conditioners, eliminates drilling and overcuts; bottom cut—lightweight portability and hand-held maneuverability allow clean cuts to bottom or base of wall; notch cut—any size notch cut is cleanly and rapidly accomplished including butted corners and angles; and trim cut trim or expansion joint cuts to a full 16 inches increase single tool versatility.

Following is a comparison of the belt based cutting system 10 of this invention to the chain-based and stone slab saw prior art devices which discloses the following:

Belt/Chain/Stone Slab Saw—Comparison a. A reduction of mass/the reduced inertia allows the belt 28 to run 40% faster than the prior art devices.
b. A reduction of centrifugal effects/belt flailing is minimized since it stays in 90° "V" guide rails.
c. A reduced width/less material removal means less horsepowerless cleanup.
d. A reduced segment height/belt height to width aspect ratio stabilizes the belt.
e. A reduced cost/makes the system more desirable and more affordable.
f. A reduced aspect ratio/ permits better control of the dynamics of the belt.
g. Reduced premature loss of side clearance/provide means to limit and control.
h. Reduced choices/narrows the field problems when the "wrong" belt is used.
i. Reduced frequent tensioning requirements/designed auto-tensioning system.
j. Design a known life expectancy for each of the belt designs/cross sectional design and engineered plastics will yield known quantities through extensive testing.
k. Design-in color coding and part no. systems/belt manufacture will allow for molding belts in desired colors with part numbers etc., as part of the process.

Guide Bar/Chain Guide Bar/Belt Guide Bar a. reduce overall weight/the lighter the tool, the more comfortable it is to use.

b. reduce bar width/this allows for a more narrow cutting component.

c. increase belt stability/changed the bar 27 top and bottom to a 90° "V" groove 48 configuration.

d. decrease water pressure drop/enlarged all supply paths.

e. introduce means of water control/bar has dual water reservoirs, distributes water more uniformly than the prior art systems, without "starving" it.

f. introduce a constant water delivery system/allows for any water supply to be connected to the tool and delivers the correct flow and working pressure.

g. minimize the bar rail wear/the belt travel over the rails offers some resistance to the escaping pressurized water, thus hydroplaning the belt and keeping cutting particulates from entering the rail and belt areas.

h. eliminate the problem nose area/designed no rotation, consumable bar nose 30 for multiple part rotating sprocket nose.

Bar Nose/Nose Sprocket a. eliminate sprocket nose bar problems/reduced part function to guiding belt down "V" groove 51 and reducing wear related sliding friction of belt 28 on bar nose 30.

b. design for consumable life expectancy/testing of various engineered plastics and metals and will allow us to determine the required properties for a known life.

c. design for recyclability/every plastic will be recyclable for environmental reasons.

In addition to the mechanical advantages of the instant invention, there are many safety advantages over chain-based cutting systems:

a. Job-specific-designed parts puts a proportionate responsibility on each part in this cutting system to do its intended function. This results in the ability to determine the life expectancy of each part in the system independent of the other parts, thus offering a reliable design factor of safety for the the tensile member (flat steel ribbon 42, wire cable 44).

b. The greatly reduced number of parts, reduces the number of potential failure points in the cutting system. This is by far the most important safety aspect addressed with this belt based cutting system, namely, the total reduction of the number of parts.

c. The greatly reduced mass of the cutting component reduces the centrifugal forces acting on the tensile member, that ultimately results in increased fatigue and reduced overall life expectancies.

d. The material removal during the cutting process is minimized by narrowing the cutting component, resulting in reduced slick working surface conditions the operators are constantly subjected to.

e. The limited interruption top surface of the abrasive resistant polymeric belt, virtually eliminates the potential for it to "hook-up" during the cutting operation, which results in a smooth cutting action and minimizes strain to the tensile member.

f. Frequent re-tensioning of the cutting component is eliminated due to the automatic tensioning system. The prior art cutting systems offer a means of manually adjusting the tension at an interval dictated by the operator of the tool, which subjects the cutting component to uneven segment wear and may result in the tendency to throw a chain from the tool, when regular re-tensioning does not occur.

In addition to the safety advantages of a belt system over a chain-based cutting system, there are many mechanical advantages:

a. The most consumable item by far will be the belt 28 and bar nose 30. Cutting of a wide variety of aggregates with a limited selection of belts 28, using a "general purpose" type segment bond/matrix 40 to satisfy 20–80% of the tool's possible cutting applications.

b. Cutting of green and abrasive aggregate concretes, man made building products such as brick, block, pre-cast hollow-core floor and ceiling panels etc., using a second "abrasive" type segment bond/matrix to satisfy 10–30% of those applications.

c. Cutting of hard aggregates with and without steel content, using a third "hard aggregate & steel" type segment bond/matrix to satisfy the balance of 10–50% of those applications.

d. Cutting of rebar laden (up to and including 1" diameter) concrete products and products having pretensioned high strength steel cable within.

e. Smaller selection of three "Belts" to cut a more broad range of materials will help simplify the belt selection process by the customer. (A 10–20% application overlap is designed in.

f. The belt based cutting system 10 of the invention has been developed to offer a direct wear relationship between each of the consumable components.

g. The belt 28 is hydroplaned throughout its excursion around the guide bar 27 using the water 46 input to cool, flush, and is hydrodynamically floating the belt 28 during operation.

h. The power to the belt 28 is transmitted by means of a high coefficient of friction sheave 29 without many points of positive engagement, thereby further eliminating the problems with the change in pitch on both chain and drive sprocket teeth.

i. The segmented belt 28 is totally encased with a highly wear resistant polymeric material that will come in contact with the workpiece during the cutting process and will also guide the belt down the guide bar 27 "V" groove 48, resulting in a very stable, very straight, and very smooth cutting tool operation.

j. The highly wear-resistant, one-piece non-rotating bar nose 30 will eliminate the majority of problems that are now experienced with the prior art systems. Replacing the bar nose bearings, inner race and sprocket of the chainsaw bar, with a single, replaceable part will help all other aspects of the cutting system 10.

k. The guide bar 30 is another consumable item in the system, and offers an integral water 46 distribution system that consists of dual reservoirs 32 to supply the required water. These two reservoirs 32 make the guide bar 27 distinctly different from all other guide bars, and allows for a minimal pressure drop between the water supply and the water exit ports, water outlets 33.

l. The water 46 will disperse into the guide bar 27 groove 48 surfaces from the reservoir 32 areas to float the belt 28 around the guide bar 27 during cutting. The hydrodynamically floating of the belt 28 under pressure over the guide bar 27 and over the bar nose 30 makes this system distinctly unique from all the prior art guide bars on the market. In addition, utilizing the hydraulic principle to "lift" the belt 28 off the bar nose 30, also eliminates the need for a rotating nose wheel.

m. The water exit ports, water outlets 33 are "sized" to proportion the water flow at a working pressure to at least six outlets 33, whereby the percentages of flow from the reservoirs will be adjusted to disperse 50–75% of the flow to the bar nose 30. This will allow the belt 28 to freely rotate around the bar nose 30 with minimal horsepower losses, while continuing to cool and flush the system.

n. The color coding of all molded parts will eliminate the problems associated with mis-identification of similar components.

o. Every consumable will be clearly identified with their respective part number for inventory control purposes.

p. Every consumable will have its respective recycling symbol molded into it, so that it can be returned to the manufacturer for a "token credit" upon purchasing new replacement components.

The performance advantages of the belt based cutting system 10 of the invention are:

a. Horsepower requirements at the cutting edge are reduce d by 20% and are proportionate to the width reduction of 20%.

b. Increased the rate of cut by 20% by narrowing the cutting component width from 0.250 to 0.200 inches and with 0.175 inches possible.

c. Increased cutting speed by 18% by running the belt 28 at 5000 surface feet per minute versus 4100 sfpm.

d. Increased resultant performance by an estimated 38%. This directly equates to an increase in productivity and product value.

e. Stabilized cutting component belt 28 by means of an operator pressure sensing belt tensioning system. The more effort an operator exerts while cutting, the tighter the belt will get until a stall occurs. This stall is an indicator for the operator to "back-off" and let the tool do the work.

f. Known wear relationships between the drive sheave 29, guide bar 27, bar nose 30, and belt 27 components, allows the "end user" to be able to quote a cutting job with confidence and at the same time be able to profit from that accurate quotation.

g. Silent operation of the friction drive system further enhances the noise abatement problems realized with the prior art chain-based cutting system.

h. The absence of articulating joints in the belt 28 further stabilizes the matrix 40 segments. It minimizes the excessive wear patterns that occur from those joints as the segment "cants" upward when it contacts the workpiece and loses potential cutting diamonds to premature wear.

i. Matrix 40 segment total length has been proportioned to its new cutting width to help stabilize the diamond cutting component which further reduces the segments' top premature wear.

j. The matrix 40 segment profile has a radius at both ends to further prevent it from "hooking up" on the material being cut.

While the present invention has been designed in connection with the preferred embodiments thereof, it will be understood that many changes and modifications of this invention may be made by those skilled in the art without departing from the true spirit and scope thereof. For example, other types of materials may be used instead of polyurethane for each of the sub-assemblies. Accordingly, the appended claims are intended to cover all such changes and modifications as fall within the true spirit and scope of the present invention. The reader is requested to determine the scope of the invention by the appended claims and their legal equivalents, and not by the examples which have been given.

What is claimed is:

1. A method for high speed cutting of various aggregate and non-aggregate, natural stone, and composite building materials containing steel or non-steel reinforced materials, the method comprising:

a) providing a continuous, flexible belt, the belt having a pentagonal shape in cross-section as defined by a 90° "V" shaped bottom, inner surface, flat side surfaces, and a flat, outer top surface, and comprising:

a tensile member base, a plurality of cutting means permanently affixed to the base, the cutting means consisting essentially of cutting segments of diamonds sintered in a metal matrix, the cutting means being spaced apart along the base, and polymeric material molded over the tensile member base and the cutting means;

b) rotating the belt on a stationary guide member, the belt being driven by a rotating friction sheave and the belt being carried over the stationary guide member by a film of pressurized water; and c) contacting the rotating belt with the building materials at a belt speed in excess of 4100 sfpm to cut the building materials;

whereby the belt hydroplanes on the stationary guide member during cutting operations.

2. The method of claim 1, wherein the tensile member base consists of a stainless steel flat belt with matrix cutting segments brazed on the belt in evenly spaced relationship.

3. The method of claim 2, wherein the flat belt is 0.010 inch thick and 0.205 inch wide.

4. The method of claim 1, wherein the tensile member base consists of a wire rope continuous loop running through anchors with the matrix cutting segments brazed to the anchors.

5. The method of claim 4, wherein the wire rope is 0.014 to 0.063 inch in diameter and has two ends and both ends of the wire rope are permanently joined together and put under tension prior to molding in the plastic.

6. The method of claim 5, wherein the ends of the wire rope are mechanically joined inside a butt connector.

7. The method of claim 1, wherein the cutting belt consists of a double wire rope continuous loop having the cutting segments brazed to anchors and the wire rope running through the anchors, and polymeric material comprising urethane is molded around the wire rope, cutting segments and the anchors.

8. The method of claim 7, wherein the anchors are crimped to the wire rope.

9. The method of claim 8, wherein the wire rope is about 0.014 to 0.063 inch in diameter.

10. The method of claim 8, wherein the tensile member base consists of a double wire rope continuous loop running through and fastened to the anchors and overlapped at the ends of the wire rope to fasten the ends when molded in the polymeric material.

11. The method of claim 1, wherein the cutting belt further comprises a plurality of reliefs adapted for removal of particulate material, the reliefs being located along the top surface of the cutting belt, within the polymeric material and between the cutting means.

12. The method of claim 1, wherein the cutting means in the cutting belt are segments comprising cobalt, nickel, carbides and diamond.

* * * * *